United States Patent [19]

Winsted

[11] Patent Number: 5,058,612

[45] Date of Patent: Oct. 22, 1991

[54] PORTABLE SPRAY CLEANING APPARATUS

[76] Inventor: Billy C. Winsted, 569 Lafayette Ave., Cincinnati, Ohio 45246

[21] Appl. No.: 509,343

[22] Filed: Apr. 16, 1990

[51] Int. Cl.[5] ..... B08B 3/02

[52] U.S. Cl. ..... 134/167 R; 134/183; 134/200; 134/177; 134/180; 239/261; 239/264

[58] Field of Search ..... 134/167 R, 169 R, 172, 134/177, 180, 200, 183; 239/282, 208, 209, 261, 264; 366/347; 15/104.062, 104.31; 49/477

[56] References Cited

U.S. PATENT DOCUMENTS

| | | | |
|---|---|---|---|
| 1,838,634 | 12/1931 | Peterson et al. | 134/167 R |
| 1,893,979 | 1/1933 | Barrere | 138/93 X |
| 2,116,935 | 5/1938 | Richard et al. | 134/167 R |
| 2,551,750 | 5/1951 | Liskey, Jr. | 49/477 X |
| 3,142,234 | 7/1964 | Maloon | 49/477 X |
| 3,343,817 | 9/1967 | Carangelo et al. | 366/347 X |
| 3,615,823 | 10/1971 | Tuma et al. | 134/24 |
| 3,696,825 | 10/1972 | Guignon et al. | 134/167 R |
| 3,724,273 | 4/1973 | Awrey | 138/93 X |
| 3,791,583 | 2/1974 | Nunlist | 134/167 R |
| 4,030,513 | 6/1977 | McKenzie et al. | 134/167 R |
| 4,354,515 | 10/1982 | Sutherland | 15/104.31 X |
| 4,373,381 | 2/1983 | Kulp et al. | 138/93 X |
| 4,386,637 | 6/1983 | Buchanan et al. | 134/167 R |
| 4,671,326 | 6/1987 | Wilhelm | 138/93 |
| 4,848,406 | 7/1989 | Stauner et al. | 138/93 |
| 4,941,493 | 7/1990 | Wieringa | 134/182 |

FOREIGN PATENT DOCUMENTS

| | | | |
|---|---|---|---|
| 2436432 | 12/1976 | Fed. Rep. of Germany | 134/167 R |

*Primary Examiner*—Frankie L. Stinson
*Attorney, Agent, or Firm*—Charles R. Wilson

[57] ABSTRACT

A portable tank spray cleaning apparatus is comprised of a manhole sealing component and a spinner spray component. The manhole sealing component is adapted for use in the manhole of a storage tank during a cleaning operation to seal the interior thereof. The sealing component comprises a cylindrical-shaped core with a base plate which fits into the manhole and a cover plate which rests on a lip of the manhole. An inflatable tube is positioned on the core. A connecting tube extends through the base plate with one end used for connection to a cleaning solution delivery hose and the other end used for connection to the spinner spray component. A vent pipe optionally also extends through the base plate to relieve a pressure build-up during a cleaning operation. In operation, the tube is pressurized to inflate it and create a seal against the sidewalls of the manhole.

15 Claims, 4 Drawing Sheets

PORTABLE SPRAY CLEANING APPARATUS

This invention relates to a spray cleaning apparatus used in the cleaning of tanks. More particularly, the invention relates to a manhole sealing component of a spray cleaning apparatus adapted for mounting in the manhole of a tank to seal the manhole during a cleaning operation.

Transport tank trucks are very prevalent throughout the country. They are used for delivering a variety of products. The products range from food materials in liquid form to hazardous chemicals used in manufacturing. The tank portion of the trucks have capacities that range up to nine thousand gallons of liquid.

Certain of the transport truck tanks are used solely for the delivery of the same product. For example, transport tank trucks which deliver gasoline from a refiner's storage facility to retail gasoline service stations are used only for that purpose. The product being carried does not change form or spoil. As such, the trucks can be used several times without a need to clean the inside of the tank. Other transport tank trucks are used for delivering non-toxic, though spoilable products such as milk. These tanks must be cleaned on a daily basis to prevent contamination of a new load. Other transport tank trucks are used for delivering any one of several different products. The tanks of these trucks must receive a thorough cleaning before being reloaded.

There are different cleaning methods commonly employed for cleaning the interior of a large capacity tank. Most commercial tanks have a manhole for inspection and repair purposes. Conceivably, a worker can enter the tank and spray down the walls of the tank. However, this method is discouraged, even when the tank has been used for holding a non-toxic material. There is always a safety question because of the cleaning solution used, inadequate ventilation, etc.

A common method of cleaning the inside of a tank is to position a liquid spray cleaner apparatus inside the tank. The spray cleaner apparatus has a nozzle portion which is capable of rotating and revolving about its axis so that all areas of the tank's interior receive the sprayed cleaning solution. One problem with this system is that the cleaning solution is likely to be sprayed out through the manhole. This produces a mess and can be dangerous depending on the temperature of the cleaning solution. Various sealing means have been used to seal off the manhole, though none are fully satisfactory for one reason or another.

There is a need for a means to effectively clean the inside of a large capacity tank in a safe and economical manner. In accord with this need, there has been developed an article of manufacture which can be attached to a conventional spray cleaner component and positioned in the manhole of a tank. The article of manufacture effectively seals the manhole without interfering with the cleaning operation.

SUMMARY OF THE INVENTION

A portable spray cleaning apparatus is comprised of a manhole sealing component and a spinner spray component. The manhole sealing component is adapted for mounting in a manhole of a tank and comprises: (a) a cylindrical-shaped core with a base plate and a removable cover plate attached thereto; (b) a connecting tube passing through the base plate with attachment means at one end to receive a cleaning solution delivery hose and attachment means at a second end to receive the spinner spray component; (c) an inflatable tube positioned on the core with valve means extending therefrom for inflating the tube to form a seal with sidewalls of the manhole; and (d) retaining means operably associated with the cover plate to secure the manhole sealing component to the tank during the cleaning operation. The base plate is dimensioned to fit through the manhole and the cover plate is dimensioned to cover the manhole and to rest on a lip thereof.

DETAILED DESCRIPTION OF THE INVENTION

The portable spray cleaning apparatus of this invention is useful for the cleaning of large capacity tanks. The tanks have a capacity of at least about 1,000 gallons. Above ground storage tanks for holding industrial liquids are one common example of the larger capacity tanks. They typically hold from about 10,000 gallons to about 30,000 gallons. Tanks which make the most use of the apparatus of this invention are permanently mounted on transport trucks and are used to carry a wide variety of materials in liquid and solid form. They typically have capacities of from about 6,000 gallons to about 9,000 gallons liquid. Most of the tanks are cylindrical-shaped with a manhole in a top surface for gaining access to the tank's interior. The manhole generally ranges in diameter from about fifteen inches to about twenty-five inches. The manhole itself is often of different lip and side wall constructions. They all have a substantially flat surface at an outside opening with a manhole cover attached, normally bolted, thereto.

Figure 1:
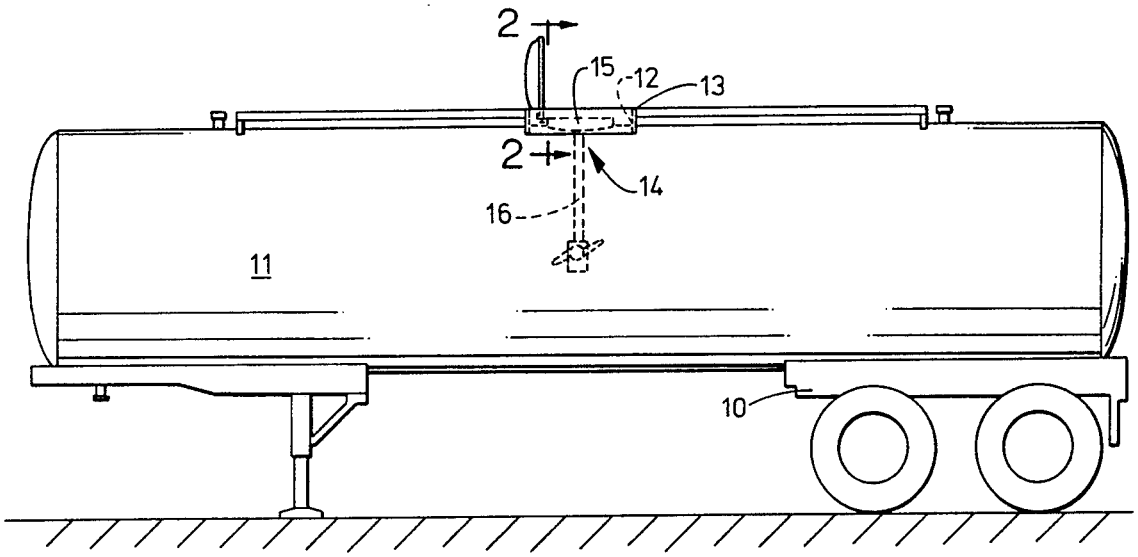
FIG. 1 is an environmental view showing the portable spray cleaning apparatus of the invention mounted for use on a tank of a transport tank truck.

Shown in FIG. 1 is a trailer portion 10 and a tank 11 of a typical transport tank truck. A manhole 12 is built into the top of the tank and extends into its interior. The manhole is circular with a flat outer lip 13. The spray cleaning apparatus 14 of this invention is shown in position ready for use. The apparatus comprises a manhole sealing component 15 depicted in the tank's manhole and a spinner spray component 16 extending from the sealing component and in position for cleaning of the tank.

As best seen in FIGS. 2–6, the manhole sealing component 15 is comprised of a cylindrical-shaped core 20 with a base plate 21 and a cover plate 22 attached thereto and further having an inflatable tube 23 positioned on the core. The core is cylindrical-shaped to provide a good sealing surface against which the inflatable tube is held. It has a diameter which is dependent on the manhole's diameter and the inflatable tube's diameter when inflated. Generally, the core is about one axis and also to rotate the nozzles about their points of attachment.

In operation, a fully assembled manhole sealing component and spinner spray component are positioned in the manhole of the tank to be cleaned. The apparatus is secured to the tank by the retaining means. A source of pressurized air is attached to the inflatable tube's valve and the tube inflated until the tube expands to contact the manhole's side walls to form a seal. Next, a cleaning solution delivery hose is attached to the connecting tube extending from the sealing component. The nozzle element is activated by the cleaning solution being pumped through the delivery hose, connecting tube, delivery tube and the nozzles. The cleaning solution is sprayed onto all areas of the tank for a sufficient time. The spent cleaning solution is continuously drained from the tank. Most importantly, the cleaning solution is prevented from exiting through the manhole. After completion of the cleaning cycle, the tube is deflated and the spray cleaner apparatus removed.

The particular cleaning solution and needed cleaning cycle times need not be discussed in detail. They will be very dependent on the material being cleaned from a particular tank. Such solutions and cleaning cycle times are well known to those skilled in the tank cleaning business.

While the invention has been described with particular references to the drawings, it should be understood various modifications can be made without departing from the basic operation of the invention. All obvious modifications are considered within the scope of the appended claims.

What is claimed is:

1. A manhole sealing component for use with a tank spray cleaning apparatus and adapted for mounting in a manhole of a tank to seal said manhole during a tank cleaning operation, said manhole sealing component comprising:

(a) a cylindrical-shaped core with a set of threaded studs extending therefrom and further having a base plate and a cover plate with a set of aligned holes in the cover plate to receive the threaded studs so as to be removably attached to the core, said base plate dimensioned to fit through the manhole and said cover plate dimensioned to completely cover the manhole and to rest on a lip thereof so as to steady the manhole sealing component during use;

(b) a connecting tube passing through the base plate with attachment means at one end to receive a cleaning solution delivery hose and attachment means at a second end to receive a spinner spray component;

(c) an inflatable tube positioned on the core with valve means extending therefrom for inflating the tube to form a seal with sidewalls of the manhole; and (d) retaining means operably associated with the cover plate of the core to secure the manhole sealing component to the tank during the cleaning operation.

2. The manhole sealing component of claim 1 further comprising a vent pipe extending through the base plate for venting pressure formed within the tank during a cleaning operation.

3. The manhole sealing component of claim 2 wherein the vent pipe is angled at an end below the base plate so that the opening of said end is substantially shielded to prevent excessive cleaning solution from entering the vent pipe.

4. The manhole sealing component of claim 2 further comprising a drain pipe extending through the base plate so that cleaning solution spilled into an interior of the core is drained therefrom.

5. The manhole sealing component of claim 4 wherein the drain pipe is angled at an end below the base plate so that the opening of said end is substantially shielded to prevent excessive cleaning solution from entering the drain pipe.

6. The manhole sealing component of claim 2 wherein the retaining means is a set of flat bars slidably attached to the cover plate to engage attachment bolts associated with the manhole of the tank.

7. The manhole sealing component of claim 2 wherein the cover plate is from about eighteen inches to about twenty-three inches in diameter and the inflatable tube is capable of expanding to at least about seventeen inches in diameter.

8. The manhole sealing component of claim 7 wherein the base plate is less than about twenty-two inches in diameter.

9. A portable tank spray cleaning apparatus adapted for mounting in a manhole during a tank cleaning operation, said apparatus having a manhole sealing component and a spinner spray component, wherein the manhole sealing component comprises:

(a) a cylindrical-shaped core with a set of threaded studs extending therefrom and further having a base plate and a cover plate with a set of aligned holes in the cover plate to receive the threaded studs so as to be removably attached to the core, said base plate dimensioned to fit through the manhole and said cover plate dimensioned to completely cover the manhole and to rest on a lip thereof so as to steady the manhole sealing component during use;

(b) a connecting pipe passing through the base plate with attachment means at one end to receive a cleaning solution delivery hose and attachment means at a second end to receive the spinner spray component;

(c) an inflatable tube positioned on the core with valve means extending therefrom for inflating the tube to form a seal with sidewalls of the manhole; and (d) retaining means associated with the cover plate of the core to secure the manhole sealing component to the tank during the cleaning operation.

10. The portable tank spray cleaning apparatus of claim 9 wherein the spinner spray component comprises a delivery tube attached to the connecting tube of the manhole sealing component at an upper end and attached to a rotatable and revolvable spray nozzle at a lower end for delivering a spray stream of cleaning solution at varying angles to the tank.

11. The portable tank spray cleaning apparatus of claim 9 further comprising a vent pipe extending through the base plate for venting pressure formed within the tank during a cleaning operation.

12. The portable tank spray cleaning apparatus of claim 11 further comprising a drain pipe extending through the base plate so that cleaning solution spilled into an interior of the core is drained therefrom.

13. The portable tank spray cleaning apparatus of claim 12 wherein the retaining means is a set of flat bars slidably attached to the cover plate to engage attachment bolts associated with the manhole of the tank.

14. The portable tank spray cleaning apparatus of claim 12 wherein the cover plate is from about eighteen inches to about twenty-three inches in diameter and the inflatable tube is capable of expanding to at least about seventeen inches in diameter.

15. The portable tank spray cleaning apparatus of claim 14 wherein the base plate is less than about twenty-two inches in diameter.

* * * * *

UNITED STATES PATENT AND TRADEMARK OFFICE

CERTIFICATE OF CORRECTION

PATENT NO. : 5,058,612

DATED : Oct. 22, 1991

INVENTOR(S) : Billy C. Winsted

It is certified that error appears in the above-identified patent and that said Letters Patent is hereby corrected as shown below:

Columns 3 and 4, as shown on the attached page, should be inserted after columns 1 and 2 and before columns 5 and 6.

Signed and Sealed this

Fifth Day of May, 1992

*Attest:*

*Attesting Officer*

DOUGLAS B. COMER

*Acting Commissioner of Patents and Trademarks* to about three inches less in diameter than the diameter of the manhole in which it is to be used. The core's height is not important, it merely being sufficient to provide a full surface for the tube to seal against when inflated.

The base plate 21 is permanently attached by welding, bolting or any other conventional attachment means to the bottom surface of the core 20. The base plate 21 is dimensioned to fit into the manhole. Preferably, its shape and size approximates the shape and size of the manhole opening. Normally, it is less than about twenty-two inches in diameter. As should be evident, the base plate serves to retain the inflatable tube on the core, retain cleaning solution in the tank and provide a measure of protection for the tube against a possibly hot cleaning solution.

The cover plate 22 is removably attached to core 20. The cover plate is generally circular-shaped with a diameter sufficiently great that it can rest on the lip of the manhole and not fall into the manhole. A set of threaded stud bolts 25 permanently secured to an inside surface of the core 20 extend vertically through aligned holes in the cover plate. The cover plate is held in position by the tightening of nuts 26 onto the stud bolts. As shown, the cover plate is open in its center area to provide access to the base plate and in effect cause the core's interior and base plate to act as a reservoir area to receive spilled cleaning solution. When the cover plate is solid, openings in its surface must be provided to allow needed piping to pass through. The cover plate is large enough to completely cover the manhole opening. Some overlap is preferred, provided the overlap does not interfere with any attachment means or auxiliary equipment found at or near the manhole. Manholes found on commercially available tanks are not uniform in size. Generally, they are from about fifteen inches to about twenty-five inches in diameter, though they normally are from about seventeen inches to about twenty-two inches in diameter. Accordingly, the cover plate normally has a diameter of from about eighteen inches to about twenty-three inches. The purpose of the cover plate is to ensure the spray cleaning apparatus is steadied in the manhole, i.e. it will remain in place during a cleaning operation.

Extending through the core 20 is a connecting tube 27. This tube has a coupling member 28 at its upper terminus to receive a cleaning solution delivery hose 29 and a second coupling member 30 at its lower terminus to receive a delivery tube of the spinner spray component. The connecting tube 27 provides a conduit for the delivery of cleaning solution from a remote storage facility to the nozzles of the spinner spray component.

The inflatable tube 23 is positioned on the core 20 by removing the cover plate and sliding the tube into position. The tube is a continuous shape made of an expandable material. It is dimensioned to fit snugly onto the core and be capable of expanding to the diameter of the manhole, generally at least about seventeen inches in diameter. Preferably, the tube is made of a polymeric elastomer such as neoprene or Buna-n rubber. Such elastomers are sufficiently tough to withstand constant inflating and deflating and constant exposure to most hot cleaning solutions. A valve 31 extending through the sidewall of the core and in communication with the interior of the tube is accessible for use in inflating and deflating it. The valve can be a one way valve or can simply be a threaded connector to receive a nozzle of an air supply hose 32 and convey pressurized air continuously to the tube while the apparatus is in use.

Figure 3:
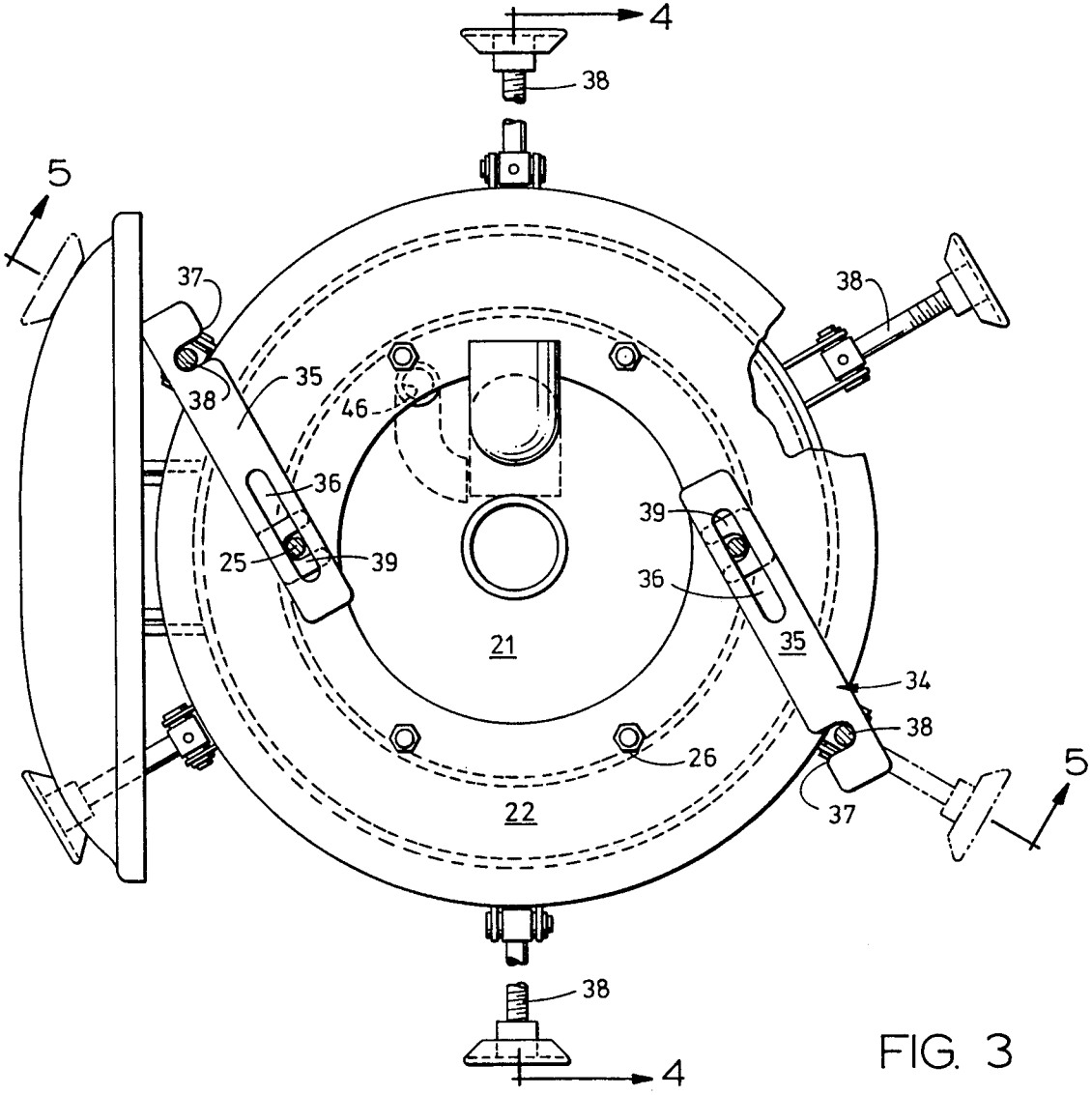
FIG. 3 is a top view of the manhole sealing component of FIG. 2.

A retaining means 34 is provided on the cover plate 22 of the manhole sealing component as a safety measure. There can be a build-up of pressure in the tank during a cleaning operation. Use of the retaining means ensures that the sealing component is not blown off its seat on the tank's manhole. The retaining means is preferably adapted to work in conjunction with manhole cover attachment means normally found on the tank. Thus, as shown in FIG. 3, a set of slidably mounted flat bars 35 have a receiving slot 36 to fit over a stud bolt 25 on the manhole sealing component. The bars also have an engagement notch 37 in another end to receive an attachment bolt 38 permanently mounted on the tank and normally used with the tank's manhole cover. A spacer 39 (evident in FIG. 5) placed on top of the cover plate is used with the stud bolts to compensate for the different heights. The slide bars 35 are capable of moving into engagement with the manhole cover attachment bolts. The slidably mounted bars are flexible in the extent to which they can reach to make the engagement. Once properly positioned, they are secured thereto by tightening a wing nut and held in place until the cleaning operation is completed. Other retaining means can as well be used, e.g. C-clamps, angle bars, etc.

Figure 2:
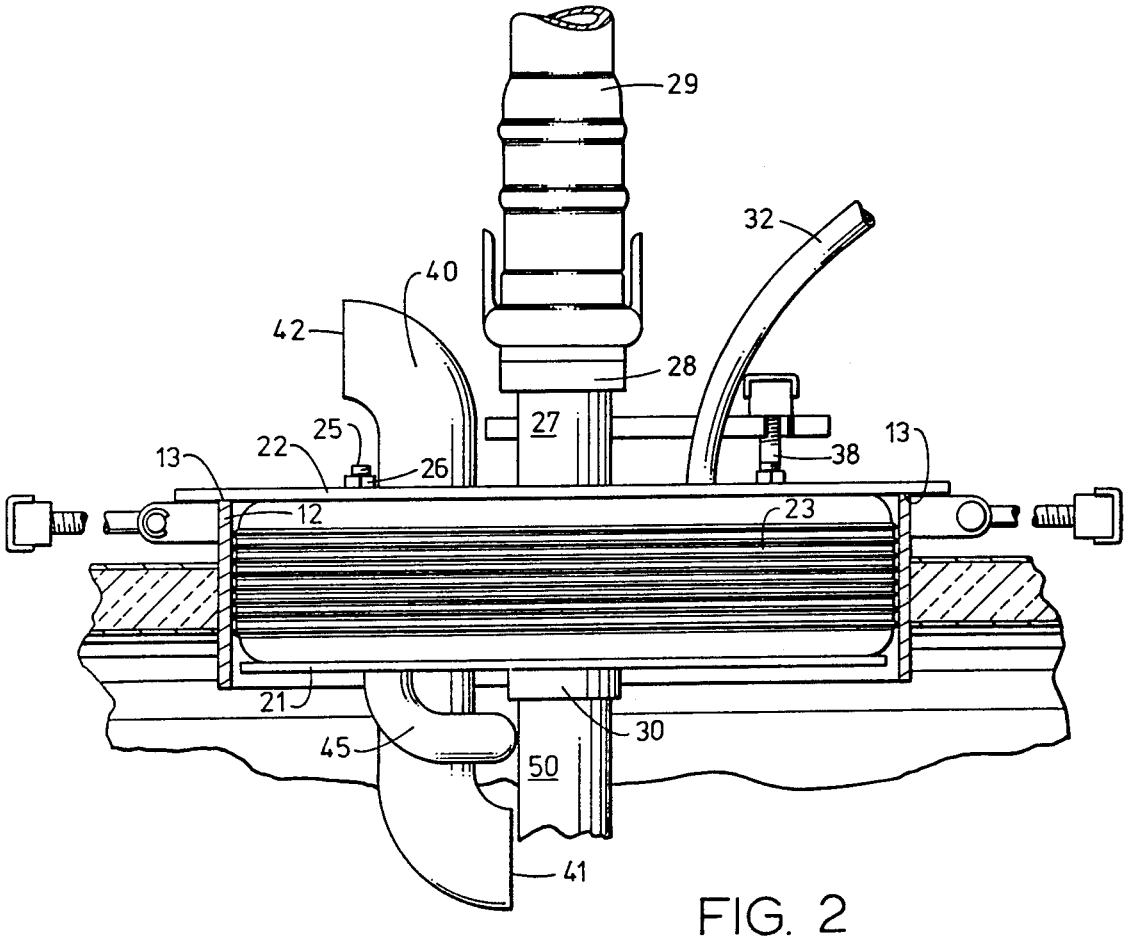
FIG. 2 is a side view partially in section showing the manhole sealing component of the spray cleaning apparatus depicted in FIG. 1.
Figure 4:
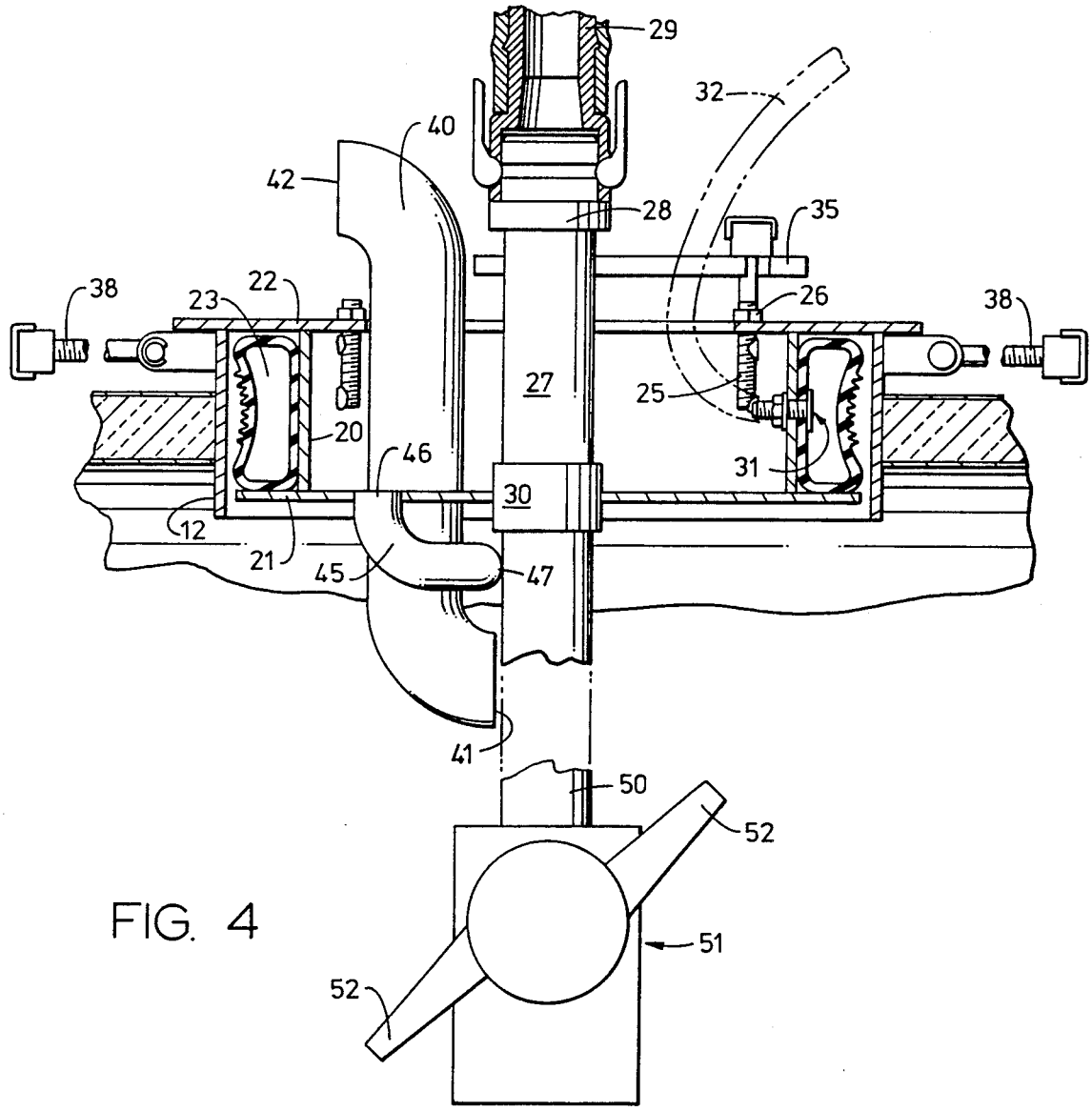
FIG. 4 is a side view partially in section taken along line 4—4 of FIG. 3.
Figure 5:
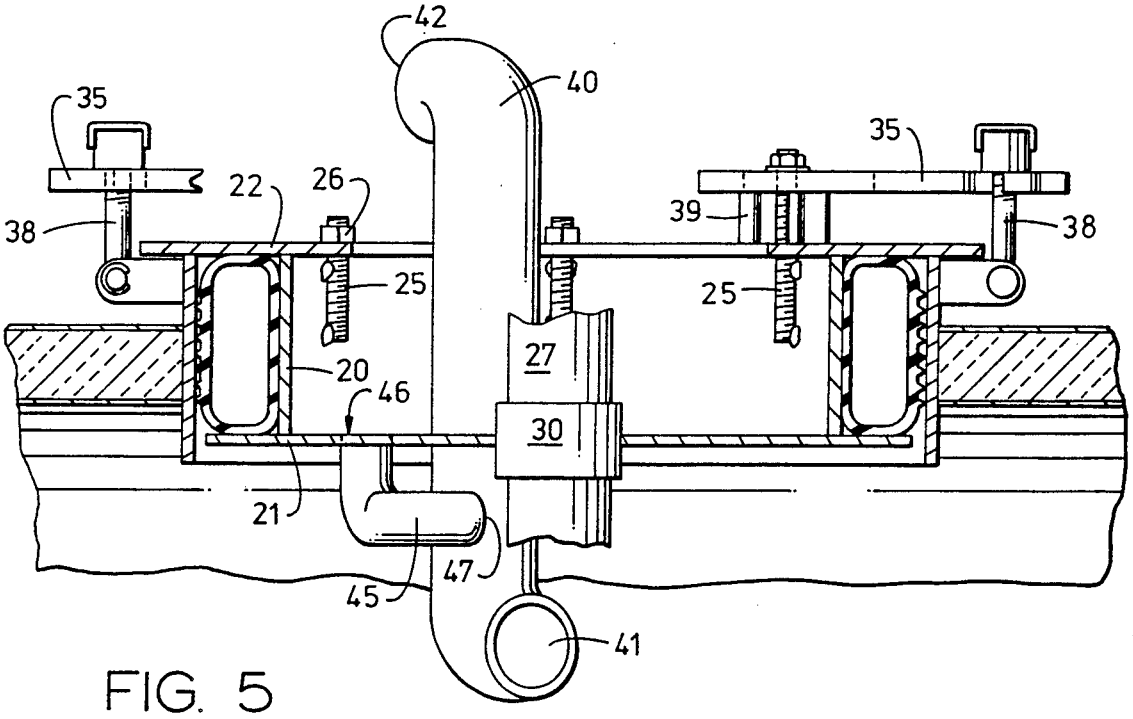
FIG. 5 is a side view partially in section taken along line 5—5 of FIG. 3.
Figure 6:
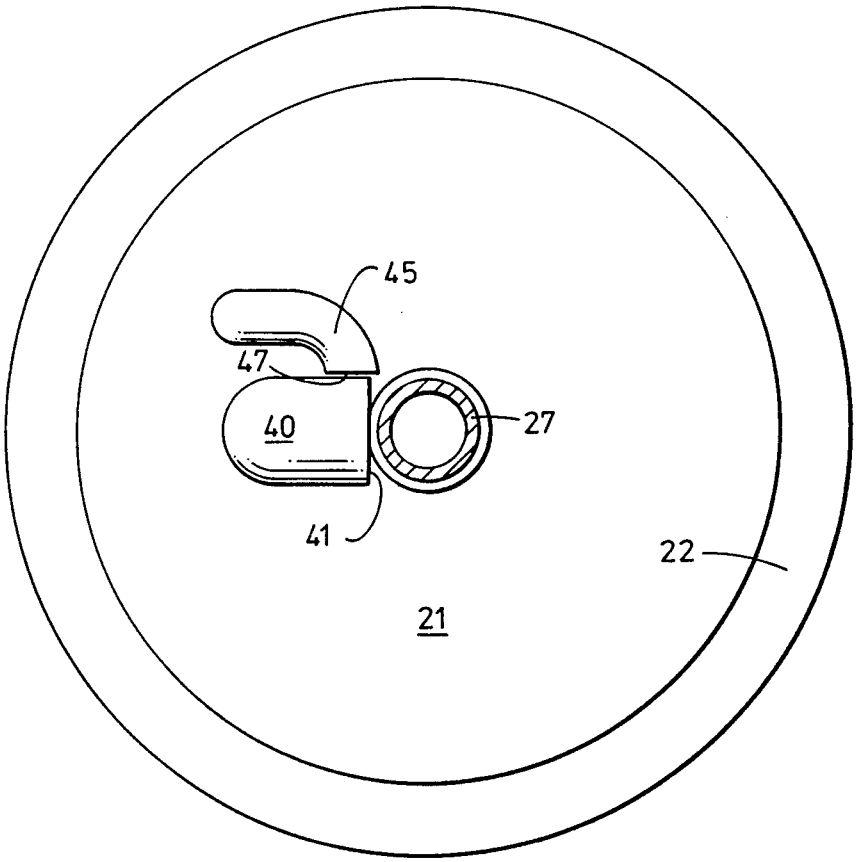
FIG. 6 is a bottom view of the manhole sealing component of FIG. 3.

An additional safety measure which is optionally included on the manhole sealing component is a vent pipe 40 to relieve a build-up of pressure in the tank. With reference to FIGS. 2, 4, and 5, a vent pipe 40 extends through the base plate and is open to the atmosphere. A vent pipe extension can be attached at the vent pipe outside terminus if needed to direct any harmful vapors or dangerous steam to a remote locale. The vent pipe is preferably angled at the end below the base plate so that its inside opening 41 is substantially vertical. As such, excessive cleaning solution is less likely to enter the vent pipe and exit through its outside opening 42. As most evident in FIG. 4, the vent pipe is angled so that its inside opening 41 is juxtaposed the delivery pipe of the spinner spray component. In effect the delivery pipe shields the opening from the cleaning solution.

In a preferred embodiment of the invention, the manhole sealing component further has a drain pipe 45 extending through the base plate 21. The drain pipe provides a means whereby spilled cleaning solution from a careless coupling of the delivery hose to the connecting tube will be conveniently disposed of. The drain pipe has a receiving opening 46 in the base plate and a discharge opening 47 below the base plate. The pipe is preferably angled at its lower end so that the discharge opening is vertical and as such less likely to receive cleaning solution during a cleaning operation. More preferably, the drain pipe is angled at its lower end so that the discharge opening is juxtaposed the spinner spray delivery pipe to shield its opening.

The above described manhole sealing component is used with a conventional spinner spray component. The spinner spray component 16 is available in several commercial models. They all have a delivery tube 50 and a spinner spray nozzle head 51. The delivery tube readily attaches to the terminus of the connecting tube 27. The spinner spray nozzle head shown has two nozzles 52 positioned near the bottom of the delivery tube. The spinner spray head is driven by externally pumped cleaning solution to revolve about the delivery tube's